US007727079B1

(12) United States Patent
Kuhlman, Jr.

(10) Patent No.: US 7,727,079 B1
(45) Date of Patent: Jun. 1, 2010

(54) LASER GOLF ALIGNMENT DEVICE AND METHOD

(76) Inventor: John A. Kuhlman, Jr., 8100 Ridgepointe Dr., Burr Ridge, IL (US) 60527

( * ) Notice: Subject to any disclaimer, the term of this patent is extended or adjusted under 35 U.S.C. 154(b) by 0 days.

(21) Appl. No.: 12/380,506

(22) Filed: Feb. 27, 2009

(51) Int. Cl.
*A63B 69/36* (2006.01)

(52) U.S. Cl. ..... 473/220; 473/219; 473/266

(58) Field of Classification Search ..... 473/218, 473/219, 220, 221, 222, 266, 268
See application file for complete search history.

(56) References Cited

U.S. PATENT DOCUMENTS

| | | | | |
|---|---|---|---|---|
| 5,029,868 | A | 7/1991 | Cloud | |
| 5,042,815 | A | 8/1991 | Sutton | |
| 5,165,691 | A | 11/1992 | Cook | |
| 5,435,562 | A | 7/1995 | Stock et al. | |
| 5,452,897 | A | 9/1995 | Mick | |
| 5,467,991 | A | 11/1995 | White, IV et al. | |
| 5,467,992 | A | 11/1995 | Harkness | |
| 5,713,798 | A * | 2/1998 | Brodie, Jr. | 473/55 |
| 5,738,595 | A | 4/1998 | Carney | |
| 5,759,110 | A | 6/1998 | Seibel et al. | |
| 5,810,674 | A | 9/1998 | Falossi et al. | |
| 5,818,036 | A | 10/1998 | Daly | |
| 5,873,789 | A * | 2/1999 | Torriano | 473/220 |
| 6,007,436 | A | 12/1999 | Mark | |
| 6,213,887 | B1 | 4/2001 | Carney | |
| 6,383,087 | B1 | 5/2002 | Moser | |
| 6,672,972 | B1 | 1/2004 | Stone | |
| 6,767,291 | B1 | 7/2004 | McCarthy | |
| 6,827,651 | B1 * | 12/2004 | Davis | 473/2 |
| 7,112,145 | B2 * | 9/2006 | Gaddy | 473/220 |
| 7,118,488 | B2 | 10/2006 | Chan et al. | |
| 7,134,966 | B1 | 11/2006 | Tice | |
| 7,160,198 | B2 | 1/2007 | Coates | |
| 7,207,896 | B1 | 4/2007 | Sudol | |
| 2005/0261072 | A1 | 11/2005 | Adams | |

OTHER PUBLICATIONS

"The Wire" "AccuPutt™ Laser Training System" Feb. 11, 2009.

* cited by examiner

*Primary Examiner*—Nini Legesse
(74) *Attorney, Agent, or Firm*—Clifford Kraft

(57) ABSTRACT

A portable, expandable laser golf training device that can be placed on the ground to provide alignment. The present invention can supply a plurality of light beams produced by lasers or other light sources, switchable on and off, that can be projected along the ground both in the direction of play and perpendicular to it. In a folded configuration, the device can project in four directions creating a pair of axis lines running at right angles to each other. In an expanded configuration, one of the major axis lines can be separated into two parallel lines for putting alignment by sliding the halves of the device apart. The device can be used by placing it on the ground in front of the golfer (between the golfer's feet and the ball. Two lines project outward perpendicular to the direction of play, and two or four lines project into and away from the direction of play. These lines provide alignment for the golfer. Various combinations of beams on or off can be selected by a selector switch under control of the user. The device can contain a rechargeable battery.

18 Claims, 7 Drawing Sheets

LASER GOLF ALIGNMENT DEVICE AND METHOD

BACKGROUND

1. Field of the Invention

The present invention relates generally to the field of light-aided sport improvement devices and more particularly to a laser golf or other sport alignment device and method.

2. Description of the Prior Art

There are numerous devices known in the art that place a laser or other light source somewhere on or near a golf club. For example, U.S. Pat. No. 6,007,436 teaches a laser system that helps align the golfer's feet in relation to the ball. U.S. Pat. No. 5,029,868 describes a practice high intensity light source mounted on a golf club. US 2005/0261072 describes a golf club alignment device with one or two laser units connected to a golf club. U.S. Pat. No. 5,435,562 teaches a golf club having a laser generating diode and laser reflecting prism. U.S. Pat. No. 5,042,815 describes a grid-like reference system for obtaining a properly aligned golf stance. U.S. Pat. No. 5,467,991 teaches a self-contained portable unit attachable to the shaft of a golf club that supplies a beam of light. U.S. Pat. No. 5,165,691 discloses a laser golf putter assembly mounted on the putter club. U.S. Pat. No. 5,738,595 describes a hand-held laser pointing device. U.S. Pat. No. 5,818,036 describes a laser aided practice putting device. U.S. Pat. No. 5,452,897 teaches a laser putter alignment system with a mirrored surface on the ball-striking surface of the putter club. U.S. Pat. No. 6,213,887 teaches an apparatus for practicing golf using a laser aiming device. U.S. Pat. No. 7,134,966 describes a golf putt training device using a light apparatus positioned behind the ball. U.S. Pat. No. 7,118,488 discloses a training putter with a laser line projecting device. U.S. Pat. No. 6,672,972, U.S. Pat. No. 5,467,992 and U.S. Pat. No. 7,207,896 teach hat-mounted laser golf devices. U.S. Pat. No. 7,160,198 teaches a golf club swing training system. U.S. Pat. No. 6,383,087 discloses a golf putting alignment system using lasers for determining the aiming tendencies of a golfer. U.S. Pat. No. 6,767,291 teaches a putting device that includes lasers mounted on a putter. U.S. Pat. No. 5,810,674 discloses a golf club with light sources. U.S. Pat. No. 5,759,110 teaches a swing training device with a light beam along the longitudinal axis of the golf club.

All of these and other prior art methods suffer from either having a light source attached to the moving golf club or not projecting a beam where the golfer needs it most. It would be advantageous to have a laser golf alignment system and method that can place right angle beams on the ground in the direction of ball travel and perpendicular to that direction. It would also be advantageous to be able to project two separated beams in the direction of ball travel for putting.

SUMMARY OF THE INVENTION

The present invention relates to a portable, expandable laser golf training device that can be placed on the ground to provide alignment. The present invention can supply a plurality of light beams produced by lasers or other light sources, switchable on and off, that can be projected along the ground both in the direction of play and perpendicular to it. In a folded configuration, the device can project in four directions creating a pair of axis lines running at right angles to each other. In an expanded configuration, one of the major axis lines can be separated into two parallel lines for putting alignment by sliding the halves of the device apart. The device can be used by placing it on the ground of the golfer (between the golfer's feet and the ball for iron or wood, and about a foot behind the ball for putting). The device can also be placed with the ball between the golfer and the device. Two lines project outward perpendicular to the direction of play, and two or four lines project into and away from the direction of play. These lines provide alignment for the golfer. Various combinations of beams on or off can be selected by a selector switch under control of the user. The device can contain a rechargeable battery.

DESCRIPTION OF THE FIGURES

Attention is now called to several illustrations that depict features of the present invention.

Several drawings and illustrations have been provided to aid in understanding the present invention. The scope of the present invention is not limited to what is shown in the figures.

DETAILED DESCRIPTION OF THE INVENTION

Figure 1:
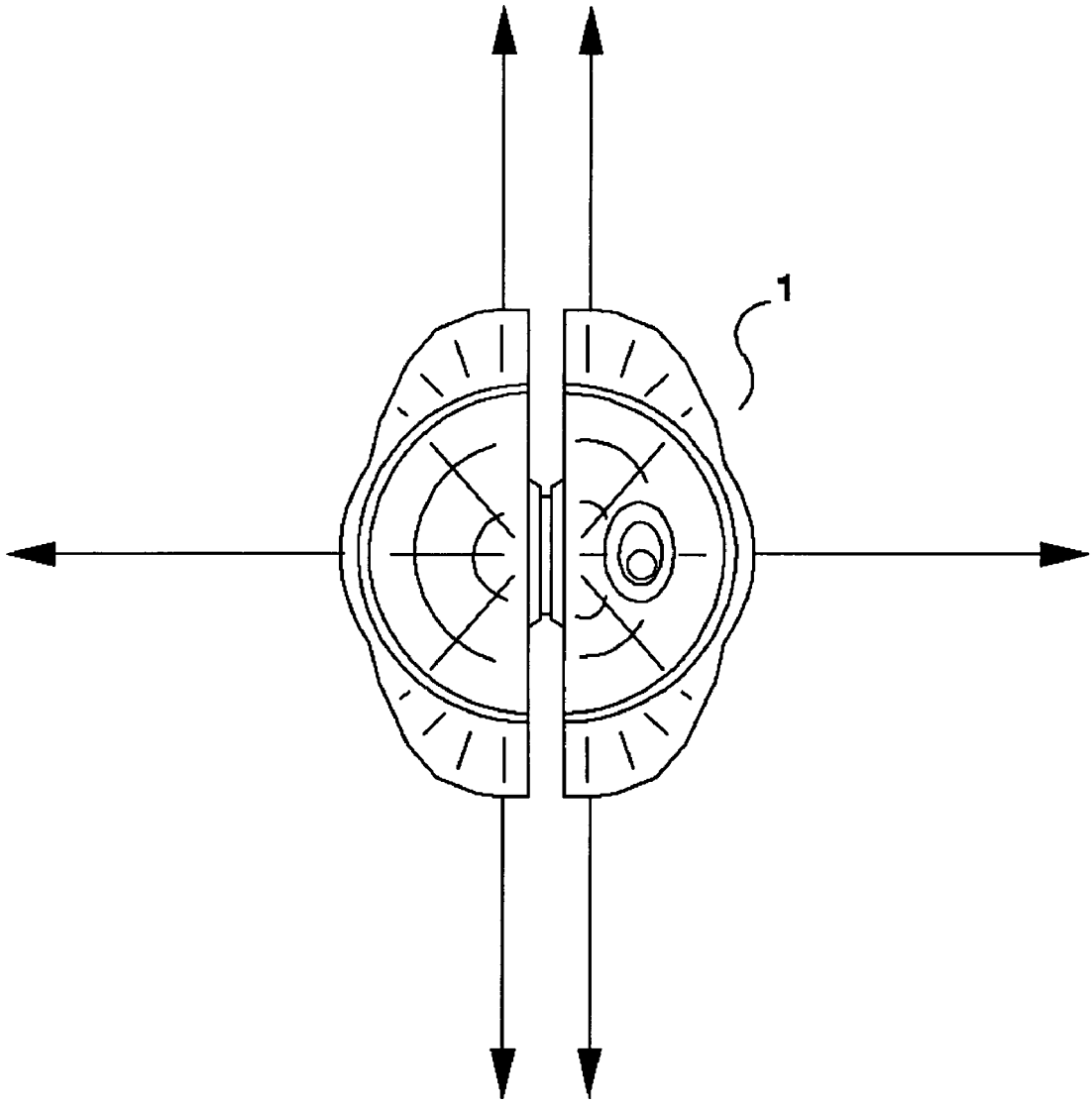
FIG. 1 shows a view of an embodiment of the present invention in the folded configuration providing four or six light beams.

The present invention relates to a golf alignment method and system that uses lasers or other light sources to project beams of light from a position on the ground between the golfer's feet and the ball. A small, battery-powered device shown in FIG. 1 can project laser beams and can be placed on the ground. In a contracted configuration, a first pair of lines is generally projected perpendicular to the direction of play (direction of ball travel). One of these first pair of lines projects outward to the ball. The second projects backward toward the golfer's feet. A second pair of lines project into and away from the direction of play (this can be four lines as shown in FIG. 1). The device can be aligned so that the lines parallel to the direction of play are correct. This causes the perpendicular lines to then also be correct. The golfer is thus in an aligned position to swing.

In an expanded configuration, a pair of parallel beams for putting can be projected along the line of play. The device can be pulled apart from the contracted to the expanded configuration to separate the lines. In any configuration, various beams can be generally switched on and off.

Figure 2:
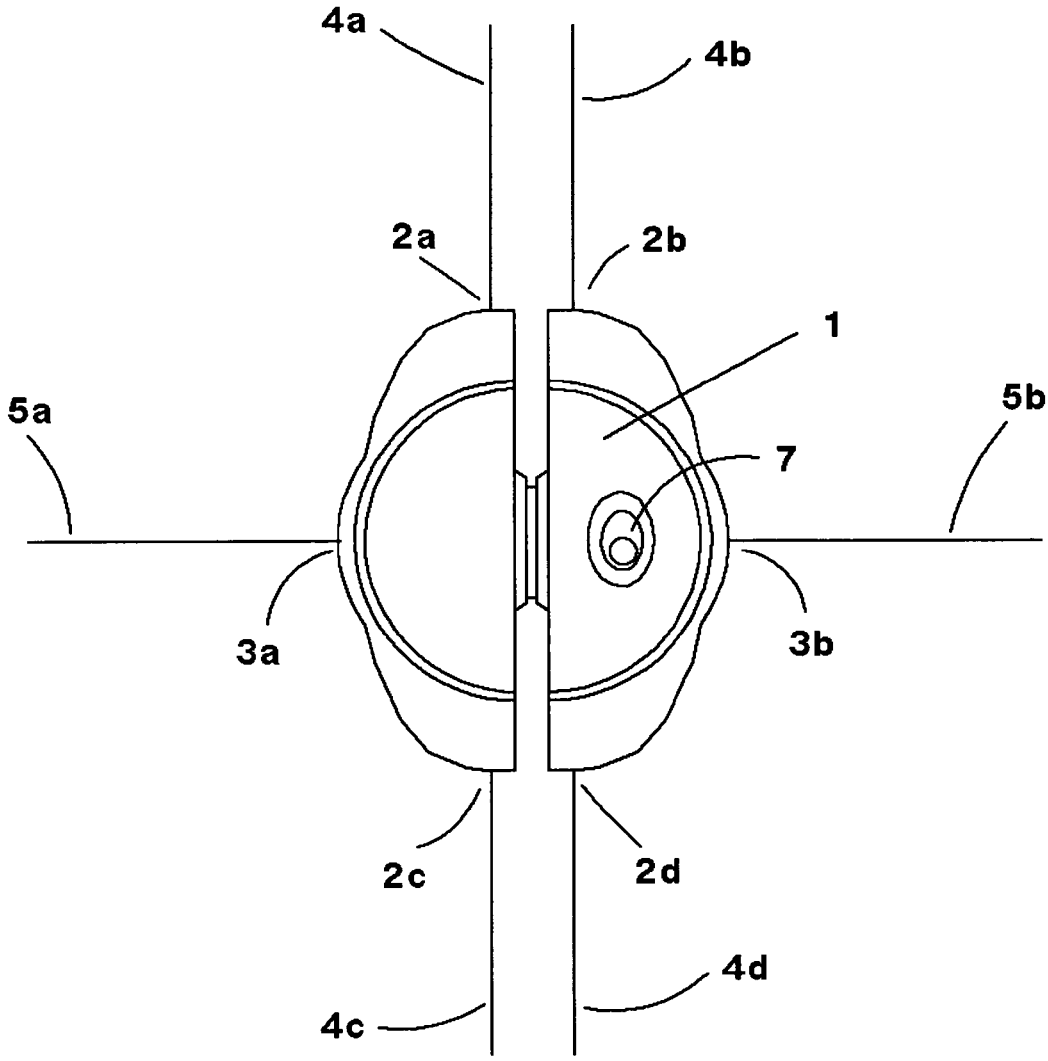
FIG. 2 is similar to FIG. 1 except that the various components of the system are labeled.

Turning to FIG. 2, a different depiction of the embodiment of FIG. 1 can be seen. The device 1 projects beams 5*a* and 5*b* perpendicular to the line of play and beams 4*a*, 4*b* and 4*c*, 4*d* parallel to the line of play. The beams are projected from lasers or laser ports 3*a*-3*b* and 2*a*-2*d*. A switch 7 on the device can switch the device on and off and control which beams are currently projecting. The configuration shown in FIGS. 1-2 is the contracted or non-expanded configuration.

Figure 3:
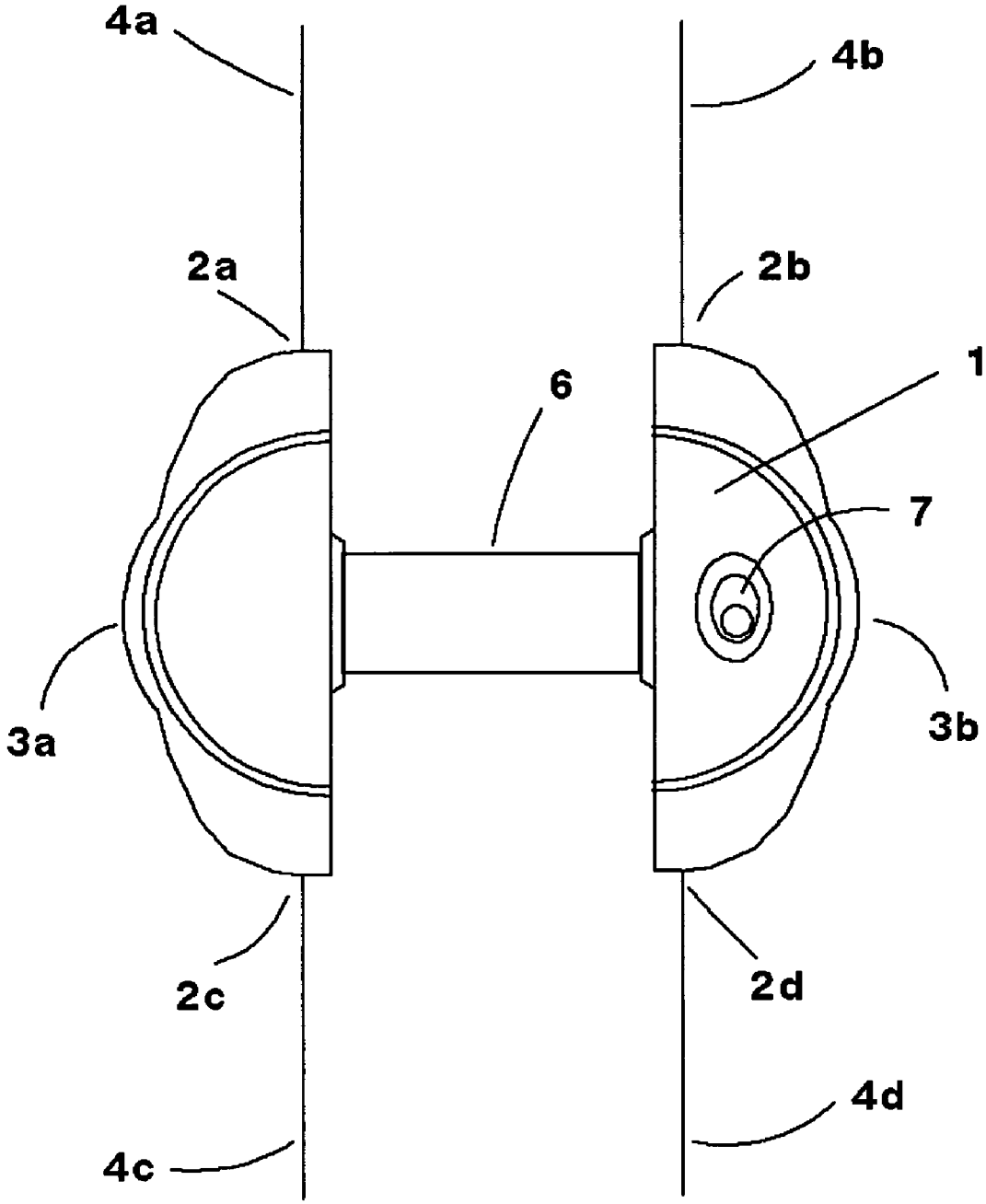
FIG. 3 shows a view of the embodiment of FIGS. 1-2 in the extended configuration providing six light beams.

FIG. 3 shows an embodiment of the device in an expanded configuration. By pulling the two halves apart the beams 4*a*, 4*c* can be separated from the beams 4*b*, 4*d*. FIG. 3 shows the other beams off. The invention can be mechanically configured to pull apart along a connecting slider bar 6. This bar 6 can connect the two halves both mechanically and electrically.

Figure 4:
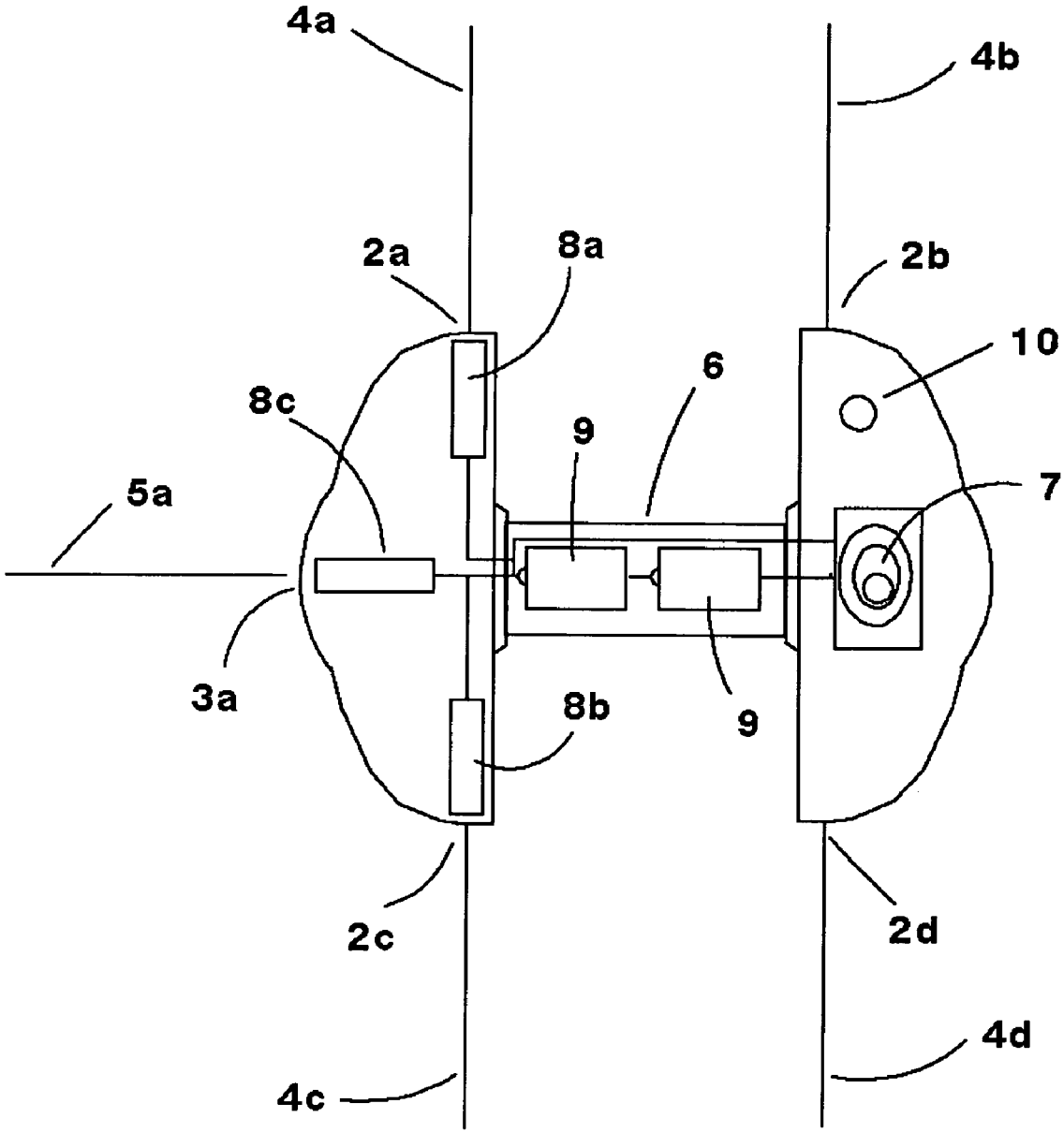
FIG. 4 shows the internal components of an embodiment of the invention.

FIG. 4 shows an embodiment of the present invention where some of the internal components can be seen. While FIG. 4 shows some connections, and the placement of some parts, various electrical connections are possible and any parts configuration is within the scope of the present invention. Three lasers 8*a*, 8*b* and 8*c* are shown in FIG. 4. These lasers are used to create beams 4*a*, 4*c* and 5*a* respectively. A pair of rechargeable batteries 9 are shown located in the center separation bar 6. The laser select and off-on switch 7 can be see along with a charging port 10 for charging the batteries 9. While two batteries 9 are shown, it will be appreciated that any number of batteries, including one, can be used to supply the correct voltage and current requirements of the device. Alternate embodiments of the invention can be made with non-rechargeable batteries.

Figure 5:
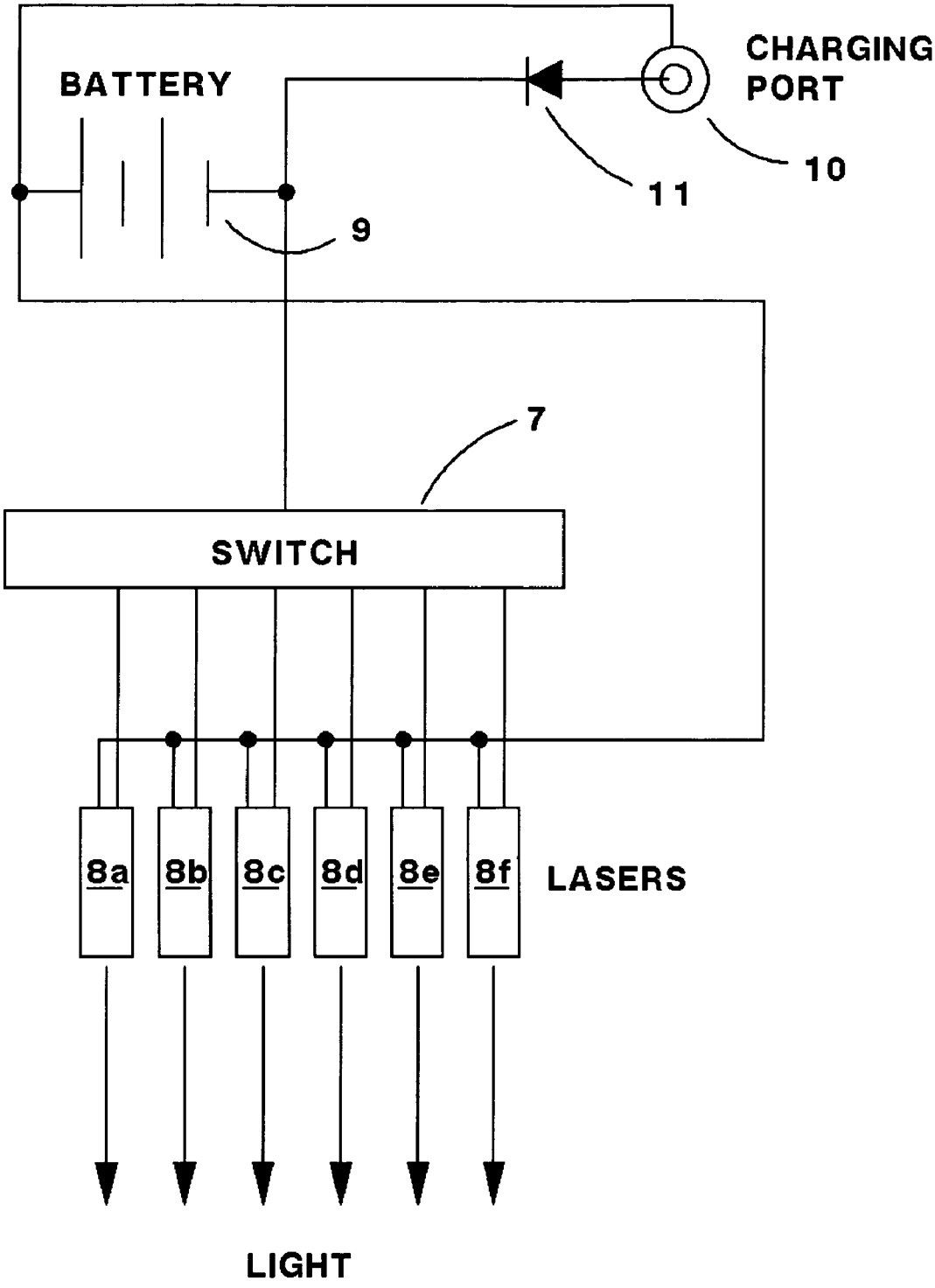
FIG. 5 shows a block diagram of the electronic portions of the invention.

FIG. 5 shows an electrical schematic diagram of an embodiment of the present invention. This schematic is representative of a preferred way of implementing the principles of the invention. It will be appreciated by one with skill in the art that numerous different circuits can be used to realize the invention. In FIG. 5, the battery 9 is connected through an optional diode 11 to an optional recharge port 10. A DC voltage from a wall transformer rectifier can be supplied to this port to recharge the battery. Alternatively, the device can include a rectifier so that AC voltage can be supplied to recharge the battery. The battery 9 is also connected to a selector switch component 7. This switch 7 can be chosen to select various desired combinations of laser beams from the various lasers 8*a*, 8*b*, 8*c*, 8*d*, 8*e* and 8*f*.

Figure 6:
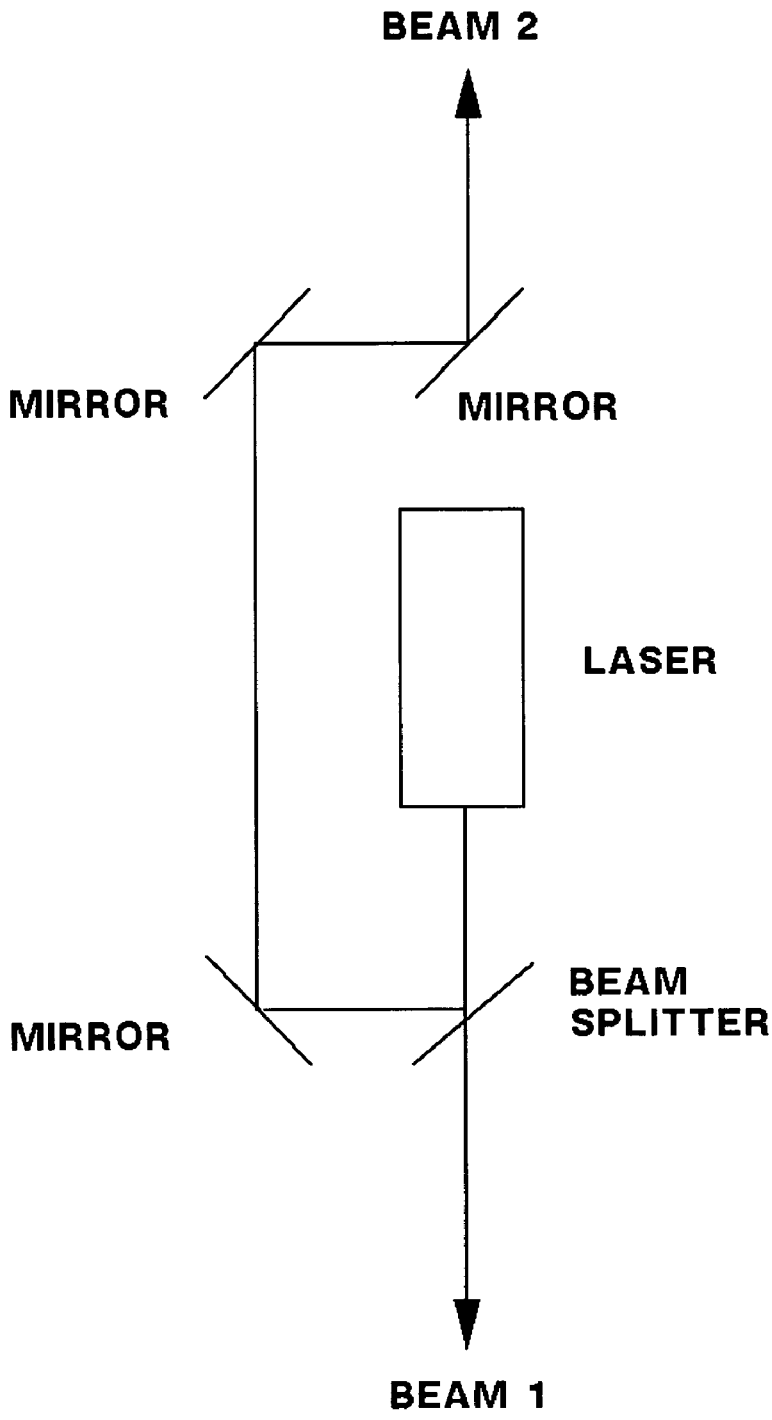
FIG. 6 shows a way of making multiple beams using a splitter and mirrors.

The embodiment of the present invention depicted in FIGS. 4-5 use several different lasers, one for each beam. It is well known in the art that a laser beam can be split. The use of a beam splitter and mirrors to cut down on the number of lasers required and the power requirements is within the scope of the present invention and is shown in FIG. 6. While this method cuts down on the number of lasers, those used must generally have more light output. In FIG. 6, the beam from a laser is split into two beams by a beam splitter. The first beam continues out of the device. The second beam is reflected by three mirrors to project out from the opposite direction from the first beam. It is within the scope of the present invention to use any number of beam splitters and mirrors to cut down on the number of lasers. Embodiments of the present invention can also be constructed with two beams, three beams, four beams and five beams of light. It is not necessary to have six beams as is shown in FIGS. 1-2.

In all cases, whether the beams are split, or whether individual lasers are used for each beam, careful alignment of the beams to be as close as possible to parallel and perpendicular is necessary. Also, all light-emitting, splitting or reflecting components should be firmly mounted to the housing to prevent shifting during use. If possible, the device should be designed to be robust in the case it is accidentally dropped of banged into something.

It should be noted that while the preceding description describes the use of lasers as light sources, any type of light source may be used such as LEDs, flashlight type beams or the like. Any type of light source of any color that can be formed into a beam is within the scope of the present invention.

Figure 7A:
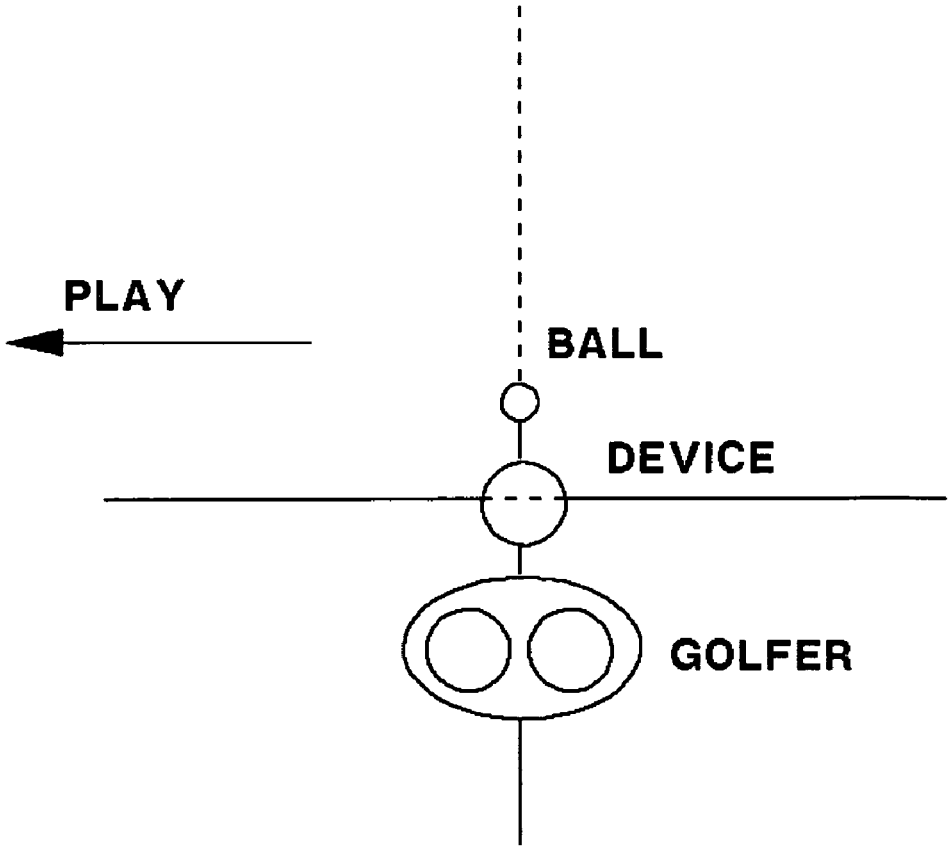
FIGS. 7A-7B show placement of the device with respect to the golfer and the ball.
Figure 7B:
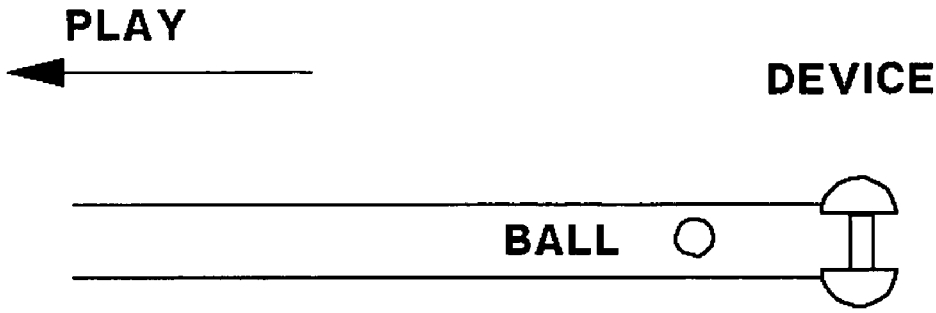

Turning to FIGS. 7A-7B, placement of the device of the present invention on the ground can be seen. FIG. 7A shows the placement is that used for wood and irons with the device positioned around half way between the golfer's shoe tips and the ball. It can also be placed with the ball between the device and the golfer. FIG. 7B shows the placement used for putting with the device around a foot behind the ball.

It should be noted that the present invention is not limited to golf or even sports. Rather, it can be used in numerous applications for alignment and making beams in a plane such as for classroom blackboards, construction, etc., and it can be used in any sport that has directions of play.

Several descriptions and illustrations have been presented to aid in understanding the present invention. One with skill in the art will realize that numerous changes and variations can be made without departing from the spirit of the invention. Each of these changes and variations is within the scope of the present invention.

I claim:

1. A sport alignment device comprising:

a housing;

at least one light source contained in said housing;

a battery contained in said housing;

at least one control switch attached to said housing;

wherein said battery is electrically connected to said control switch and to said light source, and wherein said control switch can activate or deactivate said laser; and wherein, said light source can project at least three light beams in a plane, a first beam in a direction of play, a second beam in a direction opposite to the first beam, a third beam perpendicular to the direction of play; and wherein said housing has an expanded configuration and a non-expanded configuration;

wherein when said housing is in said expanded configuration, said device can project at least two parallel beams in said plane that are separated by a predetermined distance and in the direction of play.

2. The sport alignment device of claim 1 wherein said device can project six beams in said plane when said housing is in said expanded configuration, two of said beams in the direction of play, two of said beams in the opposite direction of play and two of said beams in directions perpendicular to said direction of play.

3. The sport alignment device of claim 1 wherein when said housing is in said expanded configuration, said device can project at least two parallel beams in said plane that are separated by a predetermined distance and in the direction of play and two other parallel beams in said plane that are also separated by said predetermined distance and in the opposite direction of play.

4. The sport alignment device of claim 1 wherein said housing can be changed from said non-expanded configuration to said expanded configuration by pulling a first half apart laterally from a second half along a slider member.

5. The sport alignment device of claim 1 wherein said battery is rechargeable.

6. The sport alignment device of claim 1 wherein said housing is generally spherical when in said non-expanded configuration.

7. The sport alignment device of claim 1 wherein each of said beams is produced by a laser.

8. The sport alignment device of claim 7 wherein said laser is a solid-state laser.

9. A golf alignment device comprising:

an expandable housing of two parts connected by a connecting member, said housing containing a battery, a control switch and six lasers, each laser powered by said battery with each half of said housing containing three of said lasers, said expandable housing having an expanded configuration and a non-expanded configuration;

wherein, a first laser in a first half of said housing is pointed in a relative direction of around zero degrees, a second laser in said first half is pointed in a relative direction of around 90 degrees, and a third laser in said first half is pointed in a relative direction of around 180 degrees; and wherein a first laser in a second half of said housing is pointed in a relative direction of around 180 degrees, a second laser in said second half is pointed in a relative direction of around 270 degrees, and a third laser in said second half is pointed in a relative direction of around 0 degrees; and wherein when said housing is in said expanded configuration said first laser in said first half and said third laser in said second half project two parallel beams in a relative direction of around 0 degrees, and said third laser in said first half and said first laser in said second half project two parallel beams in a relative direction of around 180 degrees, said beams projected around 0 degrees being separated by a particular distance, and said beams projected around 180 degrees being separated by the same particular distance; and wherein said control switch is configured to select different combinations of said lasers.

10. The golf alignment device of claim 9 wherein said battery is rechargeable.

11. The golf alignment device of claim 9 wherein said housing can be changed from said non-expanded configuration to said expanded configuration by pulling a first half apart laterally from a second half along said connecting member.

12. An alignment device comprising a housing containing a first movable part and a second movable part connected by a connecting member, wherein said first movable part and said movable second part can move apart from each other up to a maximum distance determined by said connecting member's length:

at least one light source contained in said housing, said light source adapted to produce a first light beam and a second light beam, said first and second light beams being nearly parallel, wherein said first light beam is projected from said first part of said housing, and said second light beam is projected from said second part of said housing and wherein said beams can be separated up to said maximum distance by separating said first and second parts of said housing, on said connecting member.

13. The alignment device of claim 12 further comprising a rechargeable battery powering said light source.

14. The alignment device of claim 12 wherein said light source includes at least one laser.

15. The alignment device of claim 12 wherein said light source is adapted to produce a third light beam perpendicular to the first and second nearly parallel light beams.

16. The alignment device of claim 15 said light source is adapted to produce a fourth light beam perpendicular to the first and second nearly parallel light beams and in a direction opposite to said third light beam.

17. The alignment device of claim 12 wherein said light source is adapted to produce two additional light beams projected in a direction nearly opposite to that of said first and second nearly parallel light beams, said additional light beams being separated by a distance nearly equal to that of said first and second nearly parallel light beams.

18. The alignment device of claim 12 wherein said beams can be adjustably separated.

* * * * *